US008253545B2

(12) United States Patent
Wang

(10) Patent No.: US 8,253,545 B2
(45) Date of Patent: Aug. 28, 2012

(54) ELECTRONIC DEVICE WITH KEY FOR GENERATING A LOCKING SIGNAL

(75) Inventor: Tao Wang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 322 days.

(21) Appl. No.: 12/755,478

(22) Filed: Apr. 7, 2010

(65) Prior Publication Data

US 2011/0012708 A1 Jan. 20, 2011

(30) Foreign Application Priority Data

Jul. 17, 2009 (CN) ..... 2009 1 0304496

(51) Int. Cl.
*G08B 21/00* (2006.01)

(52) U.S. Cl. ..... 340/12.28; 340/12.22; 340/12.23; 340/4.11; 340/4.34; 340/3.71; 341/175; 341/176; 398/114; 345/156; 345/167; 348/734

(58) Field of Classification Search ..... 340/4.11, 340/4.34, 4.42, 5.22, 12.22, 12.23, 12.28, 340/13.24, 13.31, 13.21, 3.7, 3.71; 341/175, 341/176; 398/114; 345/156, 167; 348/734
See application file for complete search history.

(56) References Cited

U.S. PATENT DOCUMENTS

| | | | | |
|---|---|---|---|---|
| 4,279,035 | A * | 7/1981 | Skerlos | 455/158.3 |
| 5,471,253 | A * | 11/1995 | Nguyen | 348/734 |
| 5,883,680 | A * | 3/1999 | Nykerk | 348/734 |
| 6,111,518 | A * | 8/2000 | Han | 341/176 |
| 2008/0169902 | A1 * | 7/2008 | Shiroyama | 340/5.83 |

FOREIGN PATENT DOCUMENTS

CN 2393017 Y 8/2000

* cited by examiner

*Primary Examiner* — Jennifer Mehmood
*Assistant Examiner* — Mark Rushing
(74) *Attorney, Agent, or Firm* — Altis Law Group, Inc.

(57) ABSTRACT

An electronic device includes a remote control and a host. The remote control is for generating different wireless signals. The host communicates with the remote control. The host includes a processor, a control panel, and a receiving unit. The control panel is for generating different key signals. The control panel includes a key for generating a locking signal and an unlocking signal. The receiving unit is for transferring the different key signals from the control panel to control the processor, and further for transferring the different wireless signals from the remote control to control the processor. The processor disables the receiving unit according to the locking signal and enables the receiving unit according to the unlocking signal.

10 Claims, 3 Drawing Sheets

ELECTRONIC DEVICE WITH KEY FOR GENERATING A LOCKING SIGNAL

BACKGROUND

1. Technical Field

The present disclosure relates to electronic devices, and more particularly to an electronic device with a remote control function.

2. Description of Related Art

Electronic devices with a remote control function, such as televisions, and air conditioners, are ubiquitous in people's everyday life. Remote controls corresponding to the various electronic devices are often a rather complicated apparatus to use, they have numerous features and modes for enabling and disabling even more numerous settings. At times, these remote controls can have their settings changed by accident or through misuse. A significant amount of work may be required to undo the changes made to these devices and their settings.

Therefore, there is room for improvement in the art.

BRIEF DESCRIPTION OF THE DRAWINGS

The components of the drawings are not necessarily drawn to scale, the emphasis instead being placed upon clearly illustrating the principles of the embodiments of an electronic device. Moreover, in the drawings, like reference numerals designate corresponding parts throughout several views.

DETAILED DESCRIPTION

Figure 1:
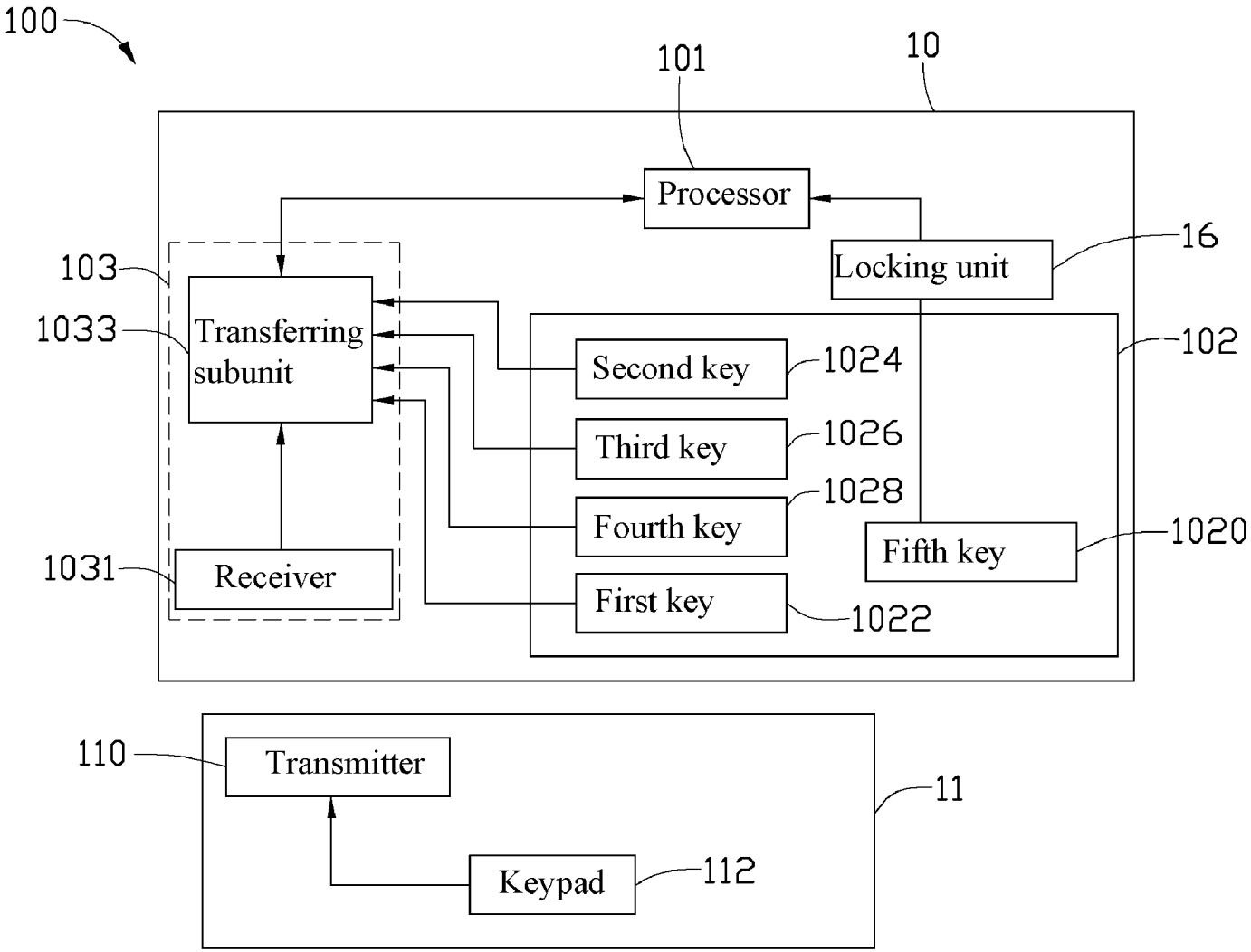
FIG. 1 is a block diagram of an electronic device in accordance with an exemplary embodiment, including a locking unit.

Referring to FIG. 1, an electronic device 100 in accordance with an exemplary embodiment is illustrated. The electronic device 100 includes a host 10 and a remote control 11 communicating with the host 10. In this embodiment, the electronic device 100 is a portable media player. In other embodiments, the electronic device 100 may be an air conditioner or a television (TV).

The remote control 11 is configured for generating different wireless signals to control the host 10. In this embodiment, the remote control 11 includes a transmitter 110 and a keypad 112. The keypad 112 is configured for being pressed, and generating different key signals accordingly. The transmitter 110 is configured for converting the different key signals into the different wireless signals, and transmitting the different wireless signals to the host 10.

The host 10 includes a processor 101, a control panel 102, a receiving unit 103, and a locking unit 16.

The control panel 102 is configured for being pressed, and generating other different key signals accordingly. The receiving unit 103 is configured for receiving the different wireless signals from the transmitter 110 of the remote control 11, and the other different key signals from the control panel 102. The receiving unit 103 includes a receiver 1031 and a transferring subunit 1033. The receiver 1031 is configured for receiving the different wireless signals from the transmitter 110 of the remote control 11 and converting the different wireless signals into the different key signals. The transferring subunit 1033 is configured for receiving different key signals from the control panel 102, and from the receiver 1031.

The processor 101 is configured for receiving the different key signals from the transferring subunit 1033, and implementing the corresponding functions. For example, the control panel 102 may include a first key 1022, a second key 1024, a third key 1026, and a fourth key 1028. The first key 1022 is configured for powering on the host 10 when the first key 1022 is switched on, and further for powering off the host 10 when the first key 1022 is switched off. The second key 1024 is configured for enabling the play function of the host 10 when it is pressed, and further for enabling the pause play function of the host 10 when it is pressed again. The third key 1026 is configured for increasing the audio volume of the host 10 when it is pressed. The fourth key 1028 is configured for decreasing the audio volume of the host 10 when it is pressed.

The control panel 102 further includes a fifth key 1020. The fifth key 1020 is configured for disabling the transferring subunit 1033 when the fifth key 1020 is switched on, and further for enabling the transferring subunit 1033 when the fifth key 1020 is switched off. In this embodiment, the fifth key 1020 implements this function by the locking unit 16.

The locking unit 16 is connected between the processor 101 and the fifth key 1020. The locking unit 16 is configured for generating a locking signal when the fifth key 1020 is switched on, and further for generating an unlocking signal when the fifth key 1020 is switched off. The processor 101 is configured for disabling the transferring subunit 1033 according to the locking signal, and further for enabling the transferring subunit 1033 according to the unlocking signal.

Figure 2:
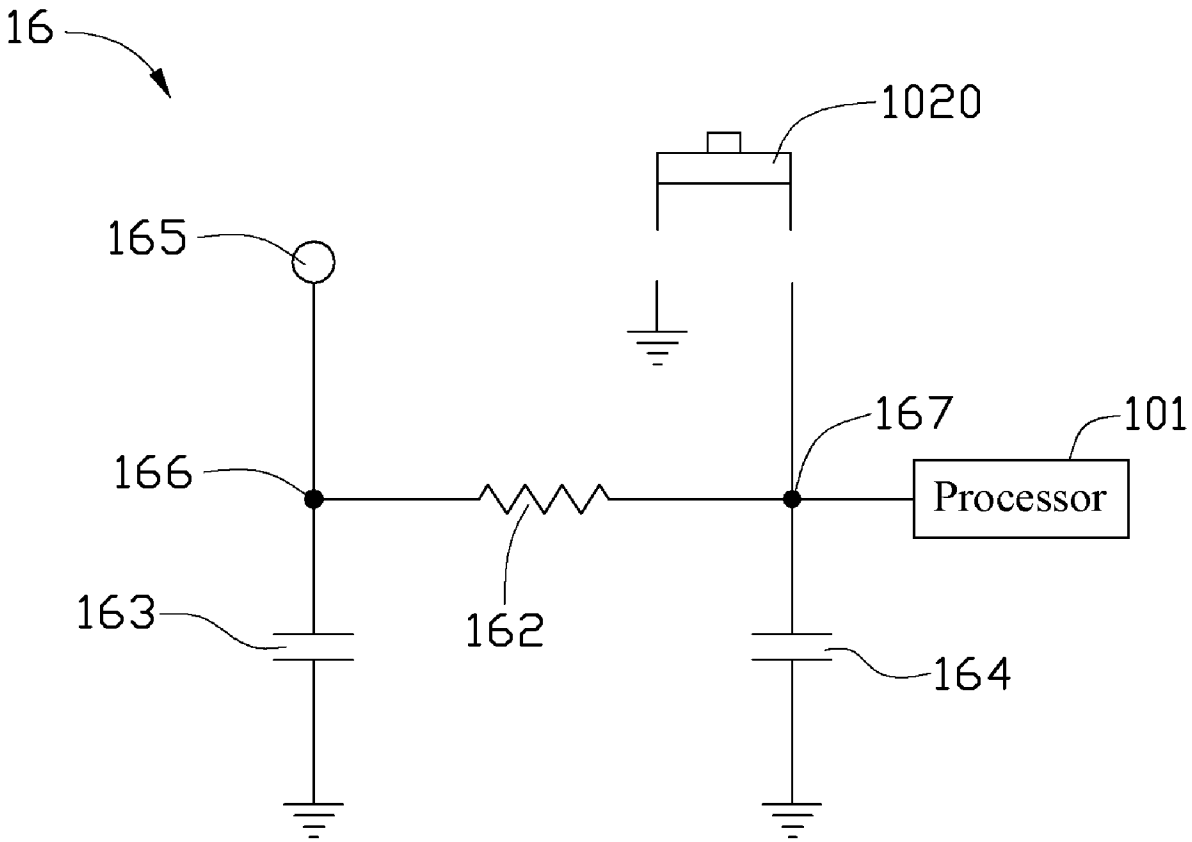
FIG. 2 is a detailed circuit diagram of the locking unit of FIG. 1.

Further referring to FIG. 2, the locking unit 16 includes a resistor 162, a first capacitor 163, a second capacitor 164, and a power supply 165. One terminal of the resistor 162 is electrically connected to the power supply 165 and one terminal of the first capacitor 163, and forms a first node 166. The other terminal of the first capacitor 163 is electrically grounded. The other terminal of the resistor 162 is electrically connected to the processor 101 and one terminal of the second capacitor 164, and forms a second node 167. The other terminal of the second capacitor 164 is electrically grounded. One terminal of the fifth key 1020 is electrically connected to the second node 167, and the other terminal of the fifth key 1020 is electrically grounded.

The resistor 162 is for limiting the current powered by the power supply 165. The first capacitor 163 and the second capacitor 164 are for filtering the current powered by the power supply 165.

When the fifth key 1020 is pressed to switch on, the second node 167 is electrically grounded to be a low level signal as the locking signal. Thus, the processor 101 receives the low level signal from the second node 167, and disables the transferring subunit 1033 accordingly. When the fifth key 1020 is pressed again to switch off, the fifth key 1020 disconnects from the second node 167. The second node 167 is a high level signal as the unlocking signal via the power supply 165. Thus, the processor 101 receives the high level signal from the power supply 165, and enables the transferring subunit 1033 accordingly.

As discussed above, when the fifth key 1020 is switched on, the transferring subunit 1033 is disabled, and the processor 101 does not receive the different key signals from the transferring subunit 1033 any more. Thus, signals from the remote control 11 and the control panel 102 will not affect the state of the host 10. When the fifth key 1020 is switched off, the transferring subunit 1033 is renewed again, and the processor 101 receives the different key signals from the transferring subunit 1033. The remote control 11 and the control panel 102 can control the host 10.

When the transferring subunit 1033 is disabled, the first key 1022 ability to power on the host 10 loses efficacy. The host 10 is locked by the fifth key 1020 completely. The host 10 should be turned off by cutting off the electricity.

In other embodiments, the first key 1022 can directly transfer a corresponding key signal to the processor 101, and the fifth key 1020 does not affect the first key 1022.

In other embodiments, the processor 101 disables the receiver 1031 according to the locking signal, and enables the receiver 1031 according to the unlocking signal. Thus, when the fifth key 1020 is switched on, the remote control 11 will not affect the processor 101. However, the processor 101 still receives the different key signals form the control panel 102, and is still affected by the control panel 102.

In other embodiments, the processor 101 is affected by the remote control 11 to implement a first group of functions and a second group of functions. The receiver 1031 of the receiving unit 103 receives a first group of control signals and a second group of control signals transmitted from the remote control 11. The processor 101 implements the first group of functions according to the first group of control signals, and implements the second group of functions according to the second group of control signals. When the processor 101 receives the locking signal generated from the fifth key 1020, the processor 101 temporarily enables the transferring subunit 1031 of the receiving unit 103 to stop receiving the second group of control signals. Such that the processor 101 keeps implementing the first group of functions without being disturbed by inadvertent operations of the remote control 11. When the processor 101 receives the unlocking signal generated from the fifth key 1020, the processor 101 enables the transferring subunit 1031 to continue receiving the second group of control signals transmitted from the remote control 11.

Figure 3:
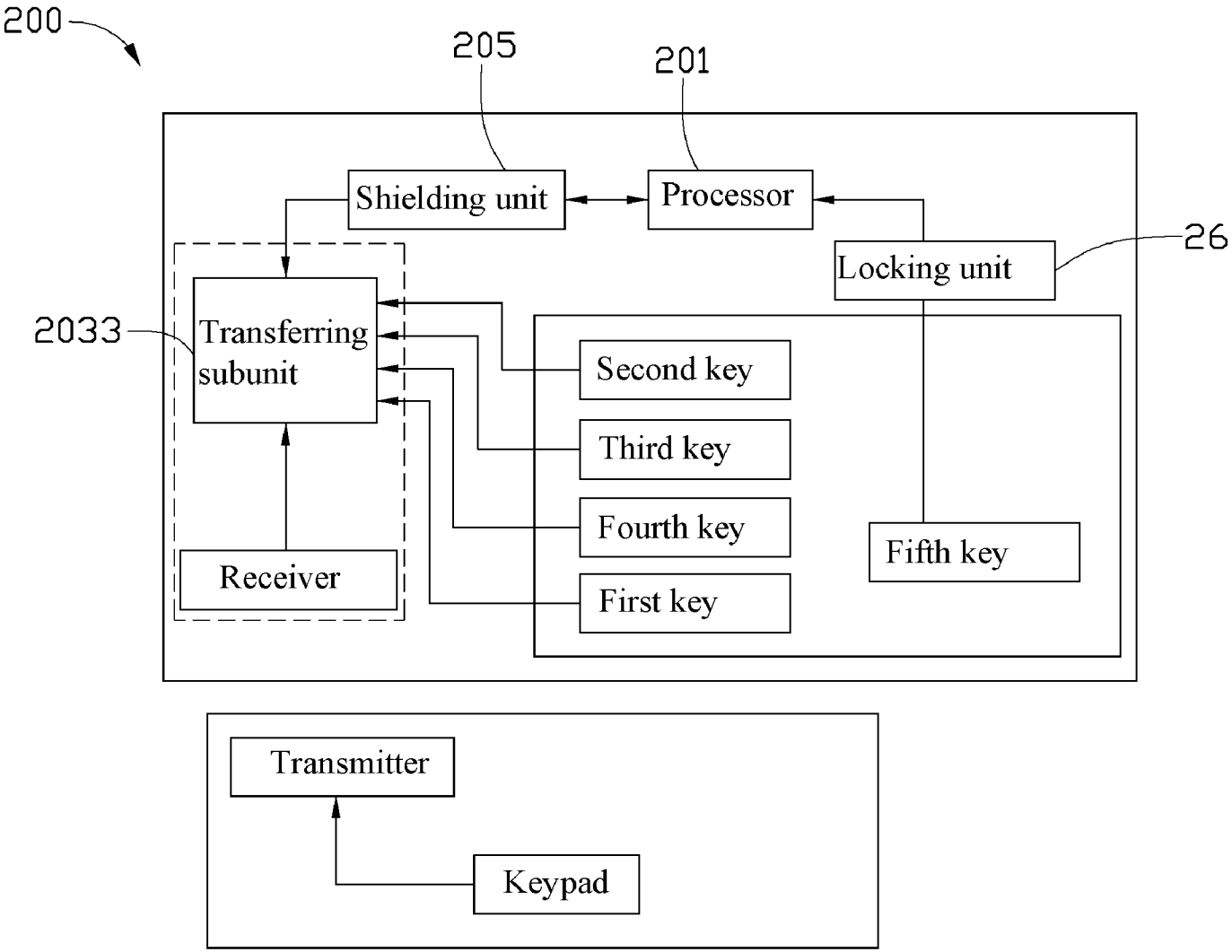
FIG. 3 is a block diagram of an electronic device in accordance with another exemplary embodiment.

Further referring to FIG. 3, another electronic device 200 in accordance with one embodiment is illustrated. The difference between the electronic device 200 and the electronic device 100 is that the electronic device 200 further includes a shielding unit 205 for shielding a transferring subunit 2033. A processor 201 enables the shielding unit 205 according a locking signal generated by a locking unit 26, and the processor 201 disables the shielding unit 205 according an unlocking signal generated by the locking unit 26.

The shielding unit 205 is another way to disconnect the processor 201 and the transferring subunit 2033. Thus, the electronic device 200 has the same advantage as the electronic device 100.

It is to be understood, however, that even though numerous has been described with reference to particular embodiments, the present disclosure is not limited to the particular embodiments described and exemplified, and the embodiments are capable of considerable variation and modification without departure from the scope of the appended claims.

What is claimed is:

1. A An electronic device, comprising:

a remote control for generating different wireless signals; and a host communicating with the remote control, the host comprising:

a processor;

a control panel for generating different key signals, the control panel comprising a key for generating a locking signal and an unlocking signal;

a receiving unit for transferring the different key signals from the control panel to control the processor, and further for transferring the different wireless signals from the remote control to control the processor; and a locking unit connected between the key and the processor, the locking unit for generating the locking signal when the key is switched on, and further for generating an unlocking signal when the key is switched off, wherein the locking unit comprises a power supply, a resistor, a first capacitor, and a second capacitor; one terminal of the resistor is electrically connected to the power supply and the other terminal of the resistor is electrically connected to the processor; one terminal of the first capacitor is electrically connected to the power supply and the resistor to form a first node, the other terminal of the first capacitor is electrically grounded; one terminal of the second capacitor is electrically connected to the processor and the resistor to form a second node, the other terminal of the second capacitor is electrically grounded, one terminal of the key is electrically connected to the second node, and the other terminal of the key is electrically grounded;

wherein the processor disables the receiving unit according to the locking signal and enables the receiving unit according to the unlocking signal.

2. The electronic device of claim 1, wherein the remote control comprises a transmitter and a keypad, the keypad is for being pressed and generating different key signals accordingly, the transmitter is for converting the different key signals into the different wireless signals, and transmitting the different wireless signals to the receiving unit.

3. The electronic device of claim 2, wherein the receiving unit comprises a receiver and a transferring subunit, the receiver is for receiving the different wireless signals from the transmitter, and further for converting the different wireless signals into the different key signals, the transferring subunit is for receiving all different key signals from the control panel and the receiver.

4. The electronic device of claim 3, wherein the processor disables the transferring subunit according to the locking signal and enables the transferring subunit according to the unlocking signal.

5. The electronic device of claim 1, wherein the host further comprises a shielding unit connected between the processor and the receiving unit, the shielding unit is for shielding the receiving unit, the processor is for enabling the shielding unit according to the locking signal and disabling the shielding unit according to the unlocking signal.

6. The electronic device of claim 1, wherein when the key is switched on, the second node is electrically grounded to generate the locking signal to the processor.

7. The electronic device of claim 6, wherein when the key is switched off, the key disconnects from the second node, and the second node generate the unlocking signal to the processor by the power supply.

8. An electronic device in communication with a remote control, the electronic device comprising:

a receiving unit for receiving different wireless signals transmitted from the remote control, and for converting the different wireless signals into different key signals;

a processor configured for receiving the different key signals, and implementing the corresponding functions accordingly;

a key operatively coupled to the processor, for generating a locking signal and an unlocking signal; and a locking unit connected between the key and the processor, the locking unit for generating the locking signal when the key is switched on, and further for generating an unlocking signal when the key is switched off, wherein the locking unit comprises a power supply, a resistor, a first capacitor, and a second capacitor; one terminal of the resistor is electrically connected to the power supply and the other terminal of the resistor is electrically connected to the processor; one terminal of the first capacitor is electrically connected to the power supply and the resistor to form a first node, the other terminal of the first capacitor is electrically grounded; one terminal of the second capacitor is electrically connected to the processor and the resistor to form a second node, the other terminal of the second capacitor is electrically grounded, one terminal of the key is electrically connected to the second node, and the other terminal of the key is electrically grounded;

wherein the processor enables the receiving unit according to the locking signal and disables the receiving unit according to the unlocking signal.

9. An electronic device being controlled by a remote control to implement a first function and a second function, the electronic device comprising:

a receiving unit for receiving a first control signal and a second control signal transmitted from the remote control;

a processor for implementing the first function according to the first control signal, and implementing the second function according to the second control signal;

a key coupled to the processor, the key switches on to generate a locking signal; and a locking unit connected between the key and the processor, the locking unit for generating the locking signal when the key is switched on, and further for generating an unlocking signal when the key is switched off, wherein the locking unit comprises a power supply, a resistor, a first capacitor, and a second capacitor; one terminal of the resistor is electrically connected to the power supply and the other terminal of the resistor is electrically connected to the processor; one terminal of the first capacitor is electrically connected to the power supply and the resistor to form a first node, the other terminal of the first capacitor is electrically grounded; one terminal of the second capacitor is electrically connected to the processor and the resistor to form a second node, the other terminal of the second capacitor is electrically grounded, one terminal of the key is electrically connected to the second node, and the other terminal of the key is electrically grounded;

wherein when the processor receives the locking signal generated from the locking unit, the processor temporarily enables the receiving unit to stop receiving the second control signal transmitted from the remote control, such that the processor continues implementing the first function without being disturbed by inadvertent operations of the remote control.

10. The electronic device of claim 9, wherein the key switches off to generate an unlocking signal, when the processor receives the unlocking signal generated from the key, the processor enables the receiving unit to continue receiving the second control signal transmitted from the remote control.

* * * * *